US007077214B2

(12) United States Patent
Vincent et al.

(10) Patent No.: US 7,077,214 B2
(45) Date of Patent: Jul. 18, 2006

(54) EXPANSION SET PACKER WITH BIAS ASSIST

(75) Inventors: Ray P. Vincent, Houston, TX (US); Dennis G. Jiral, Katy, TX (US)

(73) Assignee: Baker Hughes Incorporated, Houston, TX (US)

( * ) Notice: Subject to any disclaimer, the term of this patent is extended or adjusted under 35 U.S.C. 154(b) by 72 days.

(21) Appl. No.: 10/848,263

(22) Filed: May 18, 2004

(65) Prior Publication Data

US 2004/0256115 A1 Dec. 23, 2004

Related U.S. Application Data

(60) Provisional application No. 60/474,486, filed on May 30, 2003.

(51) Int. Cl.
*E21B 23/06* (2006.01)
*E21B 33/12* (2006.01)
*E21B 43/10* (2006.01)

(52) U.S. Cl. ..... 166/387; 166/136; 166/208; 166/214

(58) Field of Classification Search ..... 166/387, 166/125, 134, 277, 136, 208, 214
See application file for complete search history.

(56) References Cited

U.S. PATENT DOCUMENTS

| | | | | |
|---|---|---|---|---|
| 2,449,514 | A | 9/1948 | Scoville, Jr. | |
| 4,545,433 | A | 10/1985 | Wambaugh | |
| RE32,831 | E | 1/1989 | Shonrock et al. | |
| 5,062,482 | A | 11/1991 | Graham | |
| 6,431,282 | B1 | 8/2002 | Bosma et al. | |
| 6,543,780 | B1 | 4/2003 | Kogler et al. | |
| 6,752,205 | B1 * | 6/2004 | Kutac et al. | 166/187 |
| 6,854,522 | B1 * | 2/2005 | Brezinski et al. | 166/387 |
| 2005/0023003 | A1 * | 2/2005 | Echols et al. | 166/384 |
| 2005/0077053 | A1 * | 4/2005 | Walker et al. | 166/387 |

FOREIGN PATENT DOCUMENTS

| | | |
|---|---|---|
| WO | PCT/EP02/08045 | 1/2003 |
| WO | PCT/EP02/08046 | 1/2003 |

* cited by examiner

*Primary Examiner*—Jennifer H. Gay
(74) *Attorney, Agent, or Firm*—Steve Rosenblatt

(57) ABSTRACT

A packer element has a biasing member incorporated with it. The element is either fabricated with the biasing element in a relaxed condition and then the element is stretched prior to insertion downhole or the element is created around the stressed biasing member and is held in that position until allowed to relax downhole. In either event the release of the element increases its diameter while shortening its length. Preferably, an advancing swage triggers the release to allow the element to expand as much as it can go or to the maximum relaxed diameter, whichever is larger. The swage then, preferably, drives the relaxed element toward the borehole wall or the casing.

14 Claims, 5 Drawing Sheets

EXPANSION SET PACKER WITH BIAS ASSIST

PRIORITY INFORMATION

This application claims the benefit of U.S. Provisional Application No. 60/474,486 filed on May 30, 2003.

FIELD OF THE INVENTION

The field of this invention is downhole packers and more particularly those that are set with expansion force and finally those that use a bias to increase diameter independently of the applied expansion force.

BACKGROUND OF THE INVENTION

Annular spaces downhole are typically sealed with packers. Packers can be used in cased or open hole. One type of packer involves an element mounted to a mandrel, where the element is made of an elastomer. The packer is placed downhole and can be set by mechanical compression of the element. The longitudinal mechanical compression increases the diameter. Another technique has been to simply expand the mandrel to increase the outside diameter of the annularly shaped element. One such technique is the Poroflex® product from Halliburton, which uses a solid ribbed elastomer sleeve that is longitudinally compressed by an advancing swage. The driving of the swage also increases the mandrel diameter. The ribbing allows part of the sleeve to collapse on itself in a series of accordion folds. The forming of the folds is claimed to bridge the annular gap around the mandrel. The swage is sized so as not to collapse the accordion folds of the collapsed elastomer sleeve. This product is advertised for cased hole applications and appears unsuitable for open hole applications. It also has some uncertainties as to how well it will seal. Longitudinal compression will not always assure that the sleeve will collapse uniformly over the ribbed length. The sealing occurs by end contact of each accordion fold with the casing wall. The number of such ends in contact with the casing wall due to collapse and expansion is uncertain. The possibility, even in cased hole, exists for channeling between the fold ends and the casing wall. The element is not pre-stretched to reduce its run in diameter and therefore can get thinner after swaging to the point where the sealing integrity may be in question. Accordingly, a design is needed that can better address the above described sealing problems in cased hole and that has the ability to seal effectively in open hole.

The present invention employs an annular sleeve as the sealing element and mounts a biasing element with it. The biasing element stores a force, which is liberated downhole to longitudinally compress the element and increase its diameter. In a preferred embodiment the advancing swage liberates a stored force to allow the element diameter to grow to its relaxed dimension. Preferably, the advancing swage liberates this force and increases the mandrel dimension when the element is already at its relaxed diameter forcing the element into the borehole wall or the casing. How this is accomplished, so that those skilled in the art will readily appreciate the scope of the invention, will be explained more fully in the detailed description of the preferred embodiment and the claims, which appear below.

Relevant to the general area of sealing devices, with some illustrating downhole applications are U.S. Pat. Nos. 2,449,514; 4,545,433; 5,062,482; 6,543,780 B1 and Re. 32,831.

SUMMARY OF THE INVENTION

A packer element has a biasing member incorporated with it. The element is either fabricated with the biasing element in a relaxed condition and then the element is stretched prior to insertion downhole or the element is created around the stressed biasing member and is held in that position until allowed to relax downhole. In either event the release of the element increases its diameter while shortening its length. Preferably, an advancing swage triggers the release to allow the element to expand as much as it can go or to the maximum relaxed diameter, whichever is larger. The swage then, preferably, drives the relaxed element toward the borehole wall or the casing.

BRIEF DESCRIPTION OF THE DRAWINGS

FIG. 10 is a detailed view of the latch at run in;

DETAILED DESCRIPTION OF THE PREFERRED EMBODIMENT

Figure 1:
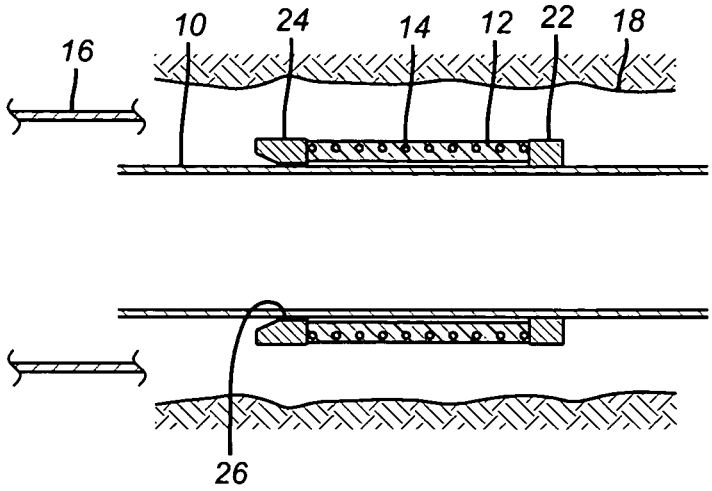
FIG. 1 is a run in cross-section of a coiled spring embodiment shown in an open hole application.
Figure 3:
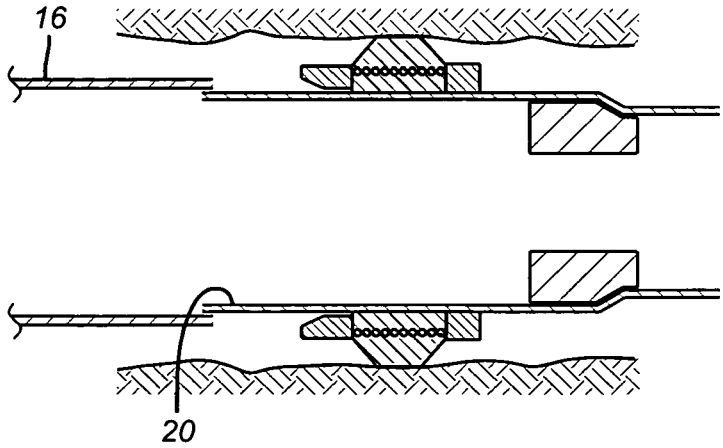
FIG. 3 is the view of FIG. 2 showing the swage advanced to expand the mandrel under the already diametrally enlarged element.

FIG. 1 shows a mandrel 10 with an element 12 that has a biasing element 14, which, in this Figure happens to be a coiled spring. Those skilled in the art will recognize that other types of biasing elements are contemplated, such as: leaf springs (see FIGS. 4–6), Belleville washers or even no biasing element at all (see FIGS. 7–9). The advantage of pre-stretching is that the initial outside diameter is reduced. For example, in a monobore application, the mandrel 10 and the element 12 must fit through the casing 16 and after expansion in open hole 18, assume an inside diameter 20 (see FIG. 3) approximating that of the casing 16. Without pre-stretching to reduce the outside diameter of the element 12 the element thickness has to be reduced for a given mandrel diameter. Later when expansion takes place in open hole, the element may not make sealing contact with the borehole wall 18.

Figure 2:
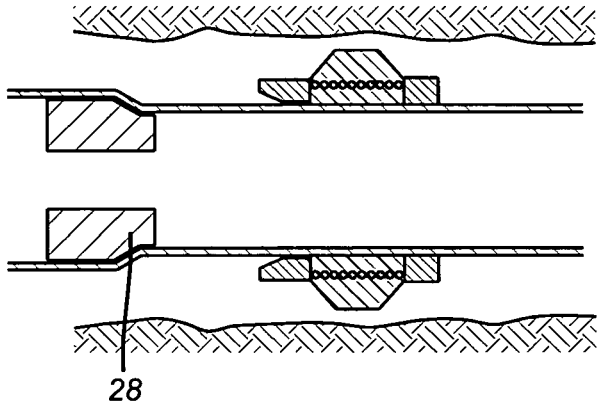
FIG. 2 is the view of FIG. 1 showing the coiled spring allowed to relax to expand the diameter of the element.

The present invention, as shown in FIG. 1, involves building a relaxed spring into the un-stretched element 12 and then stretching the assembly and holding it in that position for run in. Preferably, retainer 22 is fixed to mandrel 10 while retainer 24 is temporarily secured by a latch or another equivalent device shown schematically as 26. Advancing the swage 28 releases the latch 26 and allows the element 12 to shorten in length and to grow in diameter, aided by the stored force in spring 14. Spring 14 wants to get shorter when latch 26 is tripped. Now, as shown in FIG. 2 element 12 has shrunk in length and grown in diameter so that its outside diameter is substantially larger than during the run in. Now, when the swage 28 advances under the element 12 there is a better assurance that the element 12 will seal against the borehole wall 18. Those skilled in the art will appreciate that the illustrated embodiments of the device can be used in cased as well as in open hole.

An alternative way to make the device in FIG. 1 is to build an element 12 over an extended spring 14 and hold the element against shrinkage until it is delivered through casing 16. When the swage 28 is advanced and latch 26 is released, the spring 14 can relax and shorten the element 12 to make its diameter increase before the swage 28 expands the mandrel 10 under the element 12.

The spring 14 may be bonded to element 12, which is preferably a cured elastomer. The boding may be total or partial. Alternatively, there may be no bonding at all. The spring 14 can be totally imbedded in the element 12 or it may be partially embedded or mounted externally in a manner that its relaxation will reduce the length and increase the diameter of the element 12.

Figure 4:
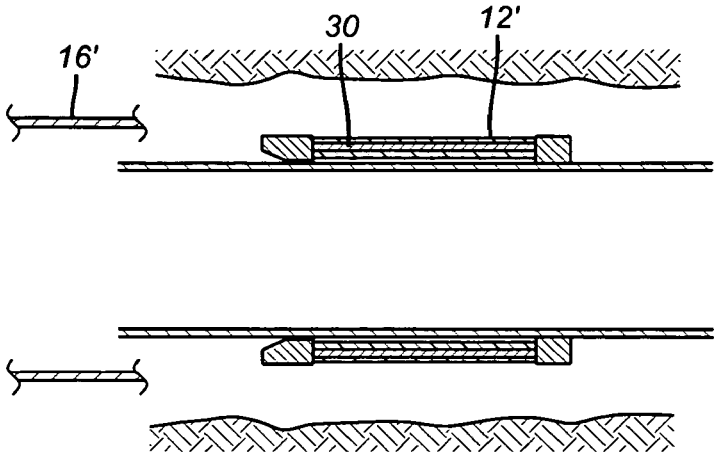
FIG. 4 is an alternate embodiment to FIG. 1 using a leaf spring and shown in the run in position.
Figure 5:
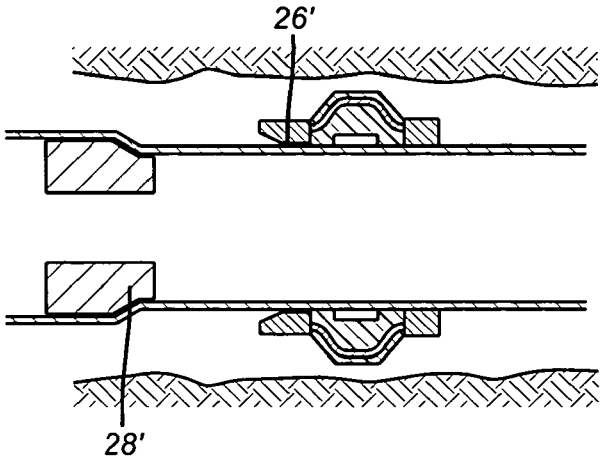
FIG. 5 is the view of FIG. 4 in the spring-relaxed position where the diameter of the element has enlarged.
Figure 6:
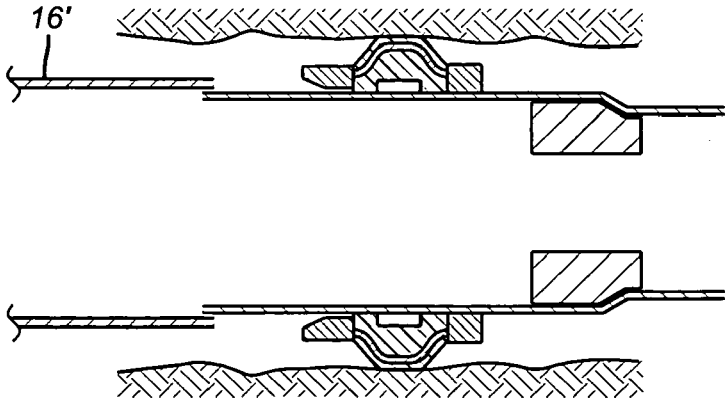
FIG. 6 is the view of FIG. 5 after expansion of the mandrel with a swage.

FIGS. 4–6 operate identically to FIGS. 1–3 and may be manufactured in the two ways described above for FIGS. 1–3. Again, the casing is 16'. The difference is that the spring is a leaf spring 30 that collapses on itself when latch 26' is released. Those skilled in the art will appreciate that the leaf spring 30 may be composed of segments that are independent or tied together or a solid ring. Similarly, spring 14 can be one or more springs which could be stacked or nested. Each coil spring can have a constant or variable diameter or a constant or a plurality of pitches. The wire diameter can vary, as can the materials of construction even within a single spring. If Belleville washers are used, they can be stacked in one direction or stacked in more than one direction and can incorporate material and dimensional variations to obtain the desired performance.

Ideally, after the element 12 or 12' has attained its relaxed large diameter shown in FIGS. 2 and 5, the expansion of mandrel 10 or 10' will ensure that there is tight sealing contact with the borehole wall. Since expansion of mandrel 10 can further reduce its length, there is an added force created on the element 12 tending to longitudinally compress it. The element 12 makes contact with the borehole 18 over a substantial portion of its length, as compared with the contact of the accordion folded ends of the Halliburton product.

Figure 7:
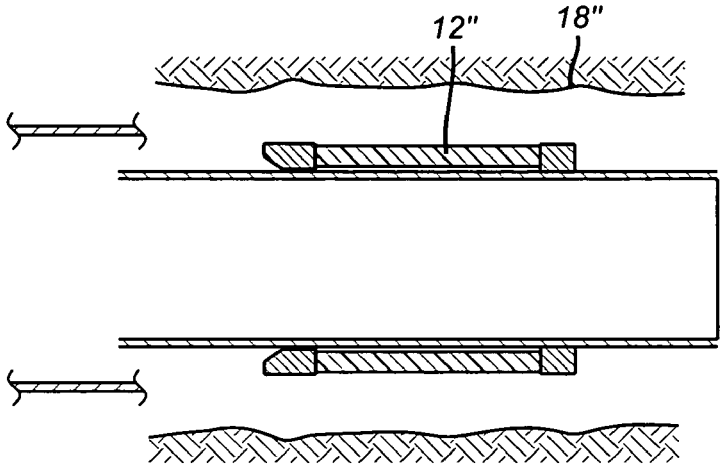
FIG. 7 is an alternative to FIG. 1 without any biasing and where the element is stretched to reduce its run-in diameter.
Figure 8:
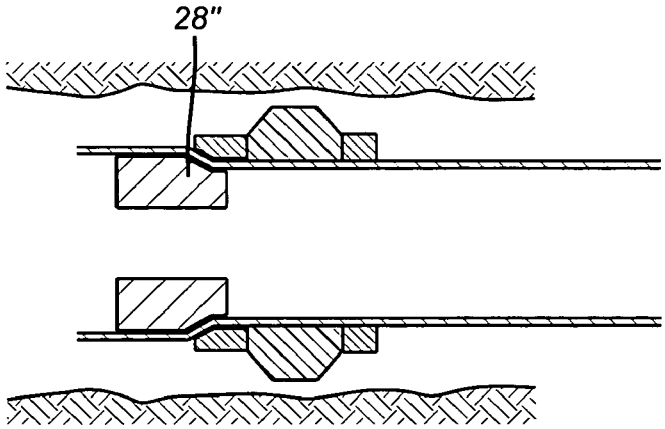
FIG. 8 is the view of FIG. 7 with the element in a relaxed position.
Figure 9:
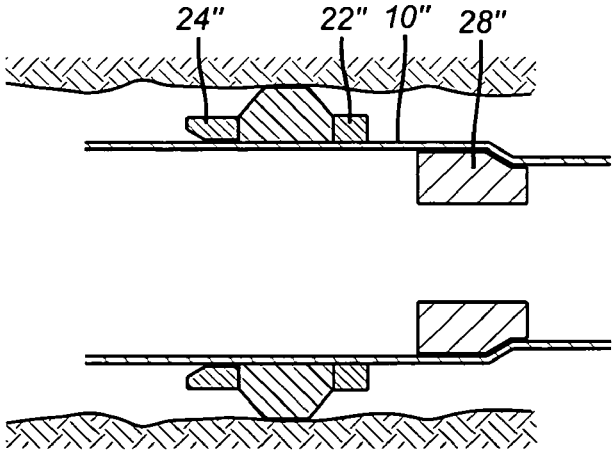
FIG. 9 is the view of FIG. 8 after the mandrel is swaged.

FIGS. 7–9 illustrate the same element 12" that now is without any associated biasing structure. It is simply initially stretched to reduce its outer dimension for run in. Advancing the swage 28" will allow it to shrink in length and expand in diameter. The mandrel 10" can then be expanded to get the element 12" up against the borehole wall 18". Here again, expansion of the mandrel past retainer 24" will result in a further compression of element 12" that is trapped between retainer 24", now fixed to mandrel 10" due to expansion and retainer 22" that was initially connected to mandrel 10". This is because diametral expansion results in a shortening of length of the mandrel 10". Alternatively, the swage 28" can actually drive the retainer 24" along mandrel 10" so that the element 12" is compressed against retainer 22".

Figure 10:
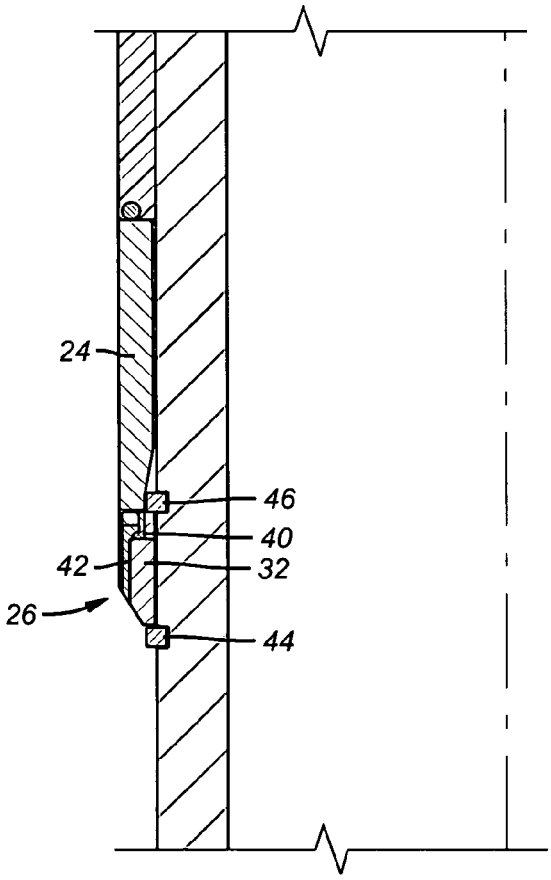
Figure 11:
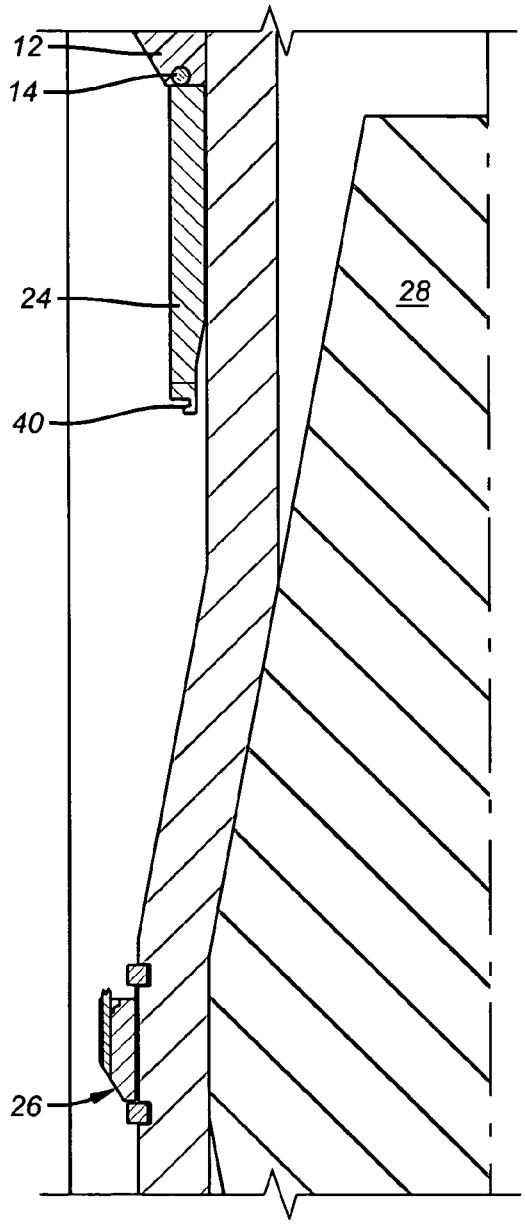
FIG. 11 is the view of FIG. 10 with expansion releasing the latch to allow the element to shrink in length and expand in diameter.
Figures 12, 13, 14, 15, 16:
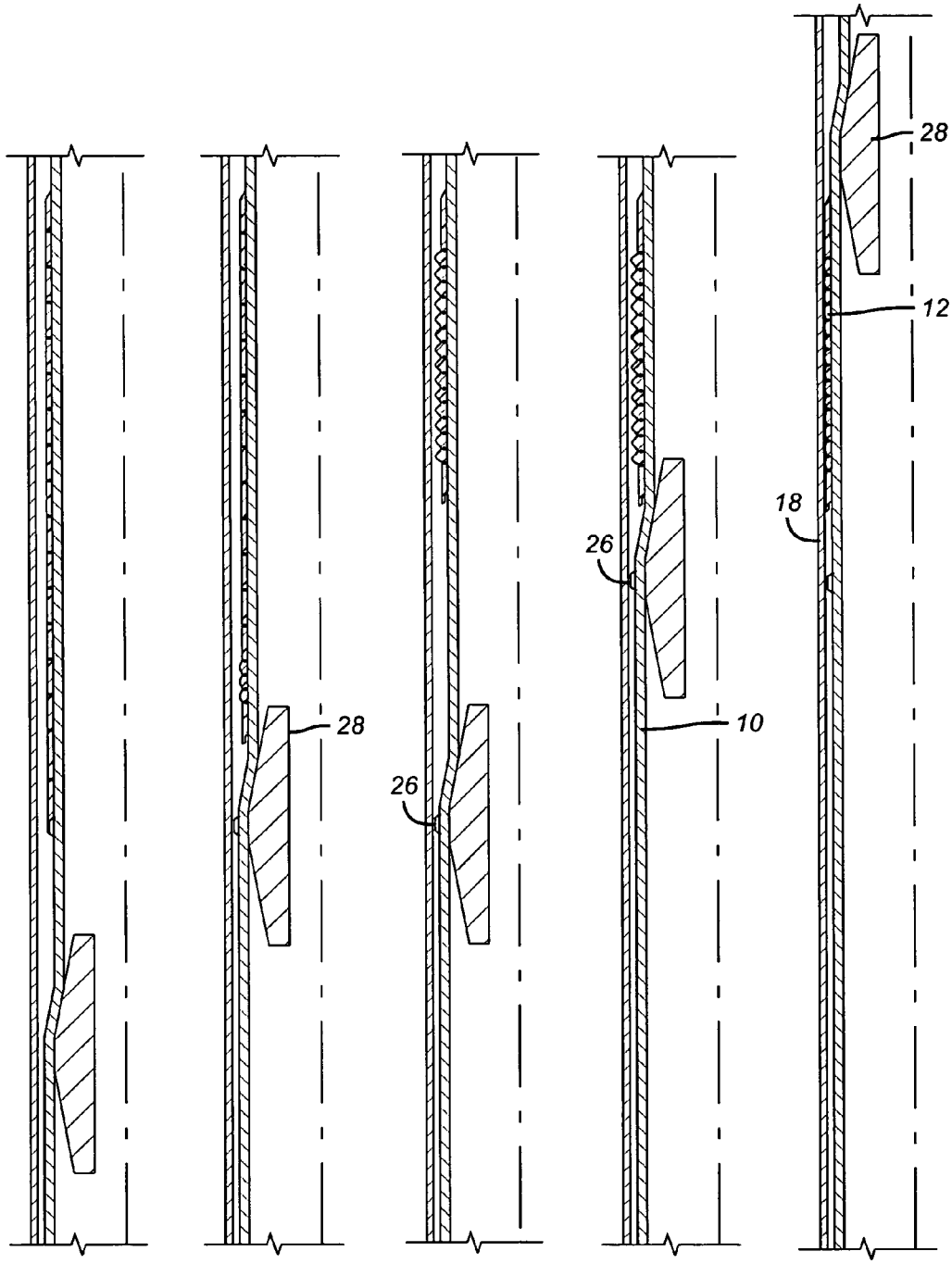
FIGS. 12–16 are a sequential view showing how the advancing swage releases the latch and passes through to finish the expansion.

FIGS. 10 and 11 show respectively, the latch mechanism 26 which is preferably a ring 32 that shears on movement of the swage 28 to allow the element 12 to shrink, shown in the run in and released position. Other devices that release on mandrel expansion are within the scope of the invention. FIG. 10 shows ring 24 having a hook 40 that is retained by ring 32. Ring 32 can be assembled in pieces that are held to each other by a breakable member 42. Ring 32 is held from moving longitudinally by retaining rings 44 and 46 that are mounted on either side of it. Rings 44 and 46 can be overlapping open rings that simply grow in diameter when the swage 28, see FIG. 11, breaks the breakable member 42 to release the hook 40 to allow the spring 14, if used, to draw up ring 24 while the element 12 shrinks in length and grows in diameter. FIGS. 12–16 show in sequence the latch release procedure just described as seen from a larger perspective. In FIGS. 12 and 13, the swage 28 approaches the latch mechanism 26. In FIG. 14 the latch mechanism 26 is released. FIG. 15 shows that on further advance of the swage 28, the latch mechanism 26 has shifted because the mandrel 10 has shrunk in length due to the expansion. FIG. 16 shows the swage 28 passing under the element 12, which is now pressed firmly against the casing wall 18.

Those skilled in the art will appreciate that the present invention reduces the element thickness by stretching it. It can then pass through casing into open hole and be released. If a biasing member is used, it will aid in the longitudinal shrinking and the radial expanding of the element. The swage can be the trigger for the release of the element and ultimately the device that expands the mandrel to force the already relaxed and larger in diameter element against the borehole wall.

The foregoing disclosure and description of the invention are illustrative and explanatory thereof, and various changes in the size, shape and materials, as well as in the details of the illustrated construction, may be made without departing from the spirit of the invention.

We claim:

1. A method of placing a packer downhole, comprising:
placing an element over a mandrel;
using a biasing member mounted to said element to create a bias force on said element;
running said mandrel into the well;
retaining said bias force from said biasing member from reshaping said element during said running;
allowing said bias force from said biasing member to reshape said element; and
expanding the mandrel to make sealing contact downhole with said element.

2. The method of claim 1, comprising:
initiating reshaping of said element by said expanding.

3. The method of claim 1, comprising:
latching said element in a stretched position;
defeating said latch with said expanding.

4. The method of claim 3, comprising:
retaining a collar connected to said element by a ring that is selectively secured to said mandrel;
breaking said ring to release said collar.

5. The method of claim 4, comprising:
using said expanding of said mandrel to break said ring.

6. The method of claim 5, comprising:
retaining said ring against shifting longitudinally along said mandrel during at least a portion of said expanding thereof.

7. The method of claim 4, comprising:
Moving said collar longitudinally along said mandrel to compress said element as said mandrel is being expanded.

8. The method of claim 4, comprising:

creating additional bias force by said pre-stretching of said element.

9. The method of claim 1, comprising:

shrinking said mandrel longitudinally from said expanding;

using said shrinking to compress said element longitudinally.

10. A method of placing a packer downhole, comprising:

placing a longitudinally stretched element over a mandrel;

running said mandrel into the well;

allowing said element to assume a relaxed position; and expanding the mandrel to make sealing contact downhole with said element;

using a biasing member to create a bias force on said element toward said relaxed position;

securing said biasing member to said element when said biasing member stores a bias force;

selectively restraining said element from longitudinal collapse against said bias force.

11. A method of placing a packer downhole, comprising:

placing a longitudinally stretched element over a mandrel;

running said mandrel into the well;

allowing said element to assume a relaxed position; and expanding the mandrel to make sealing contact downhole with said element;

using a biasing member to create a bias force on said element toward said relaxed position;

using at least one coiled spring as said biasing member.

12. A method of placing a packer downhole, comprising:

placing a longitudinally stretched element over a mandrel;

running said mandrel into the well;

allowing said element to assume a relaxed position; and expanding the mandrel to make sealing contact downhole with said element;

using a biasing member to create a bias force on said element toward said relaxed position;

at least partially embedding said biasing member in said element.

13. A method of placing a packer downhole, comprising:

placing a longitudinally stretched element over a mandrel;

running said mandrel into the well;

allowing said element to assume a relaxed position; and expanding the mandrel to make sealing contact downhole with said element;

using a biasing member to create a bias force on said element toward said relaxed position;

using at least one leaf spring as said biasing member.

14. A method of placing a packer downhole, comprising:

placing a longitudinally stretched element over a mandrel;

running said mandrel into the well;

allowing said element to assume a relaxed position; and expanding the mandrel to make sealing contact downhole with said element;

using a biasing member to create a bias force on said element toward said relaxed position;

using at least one Belleville washer as said biasing member.

* * * * *